United States Patent [19]

Yoshida et al.

[11] Patent Number: 4,854,380

[45] Date of Patent: Aug. 8, 1989

[54] HEAT EXCHANGER

[75] Inventors: Takayuki Yoshida; Kiyoshi Sakuma, both of Shizuoka; Yu Seshimo; Masao Hujii, both of Hyogo, all of Japan

[73] Assignee: Mitsubishi Denki Kabushiki Kaisha, Tokyo, Japan

[21] Appl. No.: 71,230

[22] PCT Filed: Oct. 9, 1986

[86] PCT No.: PCT/JP86/00521

§ 371 Date: Aug. 25, 1987

§ 102(e) Date: Aug. 25, 1987

[87] PCT Pub. No.: WO87/02762

PCT Pub. Date: May 7, 1987

[30] Foreign Application Priority Data

| | | | |
|---|---|---|---|
| Oct. 25, 1985 | [JP] | Japan | 60-240077 |
| Oct. 25, 1985 | [JP] | Japan | 60-240078 |
| Oct. 25, 1985 | [JP] | Japan | 60-240081 |
| Oct. 25, 1985 | [JP] | Japan | 60-240083 |

[51] Int. Cl.[4] ..... F28D 1/02

[52] U.S. Cl. ..... 165/152; 165/148; 165/151; 165/170

[58] Field of Search ..... 165/151, 152, 166, 170, 165/177

[56] References Cited

FOREIGN PATENT DOCUMENTS

| | | |
|---|---|---|
| 131656 | 10/1977 | Japan . |
| 500728 | 5/1981 | Japan . |
| 143697 | 7/1986 | Japan . |

*Primary Examiner*—Larry Jones

*Attorney, Agent, or Firm*—Sughrue, Mion, Zinn, Macpeak & Seas

[57] ABSTRACT

A heat exchanger is disclosed, which comprises a plurality of heat-transfer elements (1) placed side by side each of which has more than one through-hole (3) and which are cyclically bent in a generally trapezoidal waveform in the direction of the flow of a fluid, the bends in one heat-transfer element (1) being out of phase with those in an adjacent heat-transfer element (1) by one-half cycle in such a manner that the main stream of said fluid will flow not through the holes in each of said heat-transfer elements (1) but through the passage formed by adjacent heat-transfer elements (1). This arrangement serves to provide improved heat-transfer characteristics.

13 Claims, 10 Drawing Sheets

HEAT EXCHANGER

TECHNICAL FIELD

The present invention relates to a heat exchanger, in particular to an improvement of the heat-transfer characteristics of a heat-transfer element such as a heat-transfer fin.

BACKGROUND ART

The prior art of the present invention is hereinafter described with reference to the specification of Japanese Patent Application No. 264087/1984.

FIG. 25 is a partial perspective view of a heat-transfer unit according to one example of the prior art that is generally indicated by (1) and disposed in the direction of fluid flow A. The heat-transfer unit (1) is basically composed of heat-transfer fins, a heat generator, a heat absorber, a heat accumulator and a heat radiator. In FIG. 25, the heat-transfer unit consists of a plurality of heat-transfer elements **(1*a*), (1*b*) and (1*c*), each being provided with a plurality of through-holes (13), which are stacked one on top another and the fluid flows through the passage formed by adjacent heat-transfer elements. Each heat-transfer element (1) is cyclically bent in the direction of fluid flow A in the form of trapezoidal waves, the bends in one element being out of phase with those in an adjacent element. The action of the mechanism of the heat-transfer unit shown in FIG. 25 is hereinafter explained with reference to FIG. 26** which is a cross-sectional view of the unit.

In FIG. 26, the fluid passage formed between heat-transfer elements **(1*a*) and (1*b*) are indicated by (51), and the passage formed between (1*b*) and (1*c*) is denoted by (52). If it is assumed that the same volume of fluid flows in passages (51) and (52) under the same total pressure, the velocity of the fluid flowing in passage (51) through a cross section taken along the line X—X normal to the direction of fluid path A is smaller than the velocity of the fluid flowing in passage (52) through a smaller cross section that is also taken along the line X—X. Because of the resulting different that occurs between the static pressure in the passage (51) and that in the passage (52), part of the fluid will flow from the passage (51) into the passage (52) through-holes (13)**.

If one looks at the heat-transfer element **(1*b*), the fluid will flow cyclically from the passage (51) to (52) and vice versa in accordance with the geometry of the generally trapezoidal waveform of the element, as shown in FIG. 2**.

Therefore, if a heat-transfer unit is constructed in the manner described above in connection with an example of the prior art, surfaces where uniform fluid sucking occurs and those where uniform fluid-blowing occurs will be formed, one surface alternating with the other in the direction of fluid path. In the heat-transfer surfaces where uniform fluid-sucking occurs, very thin boundary layers will form to provide a remarkable improvement in heat-transfer, whereas in the surfaces where uniform fluid-blowing occurs, the repetition effect of promotion zones also contributes to high heat-transfer performance. These two effects combine together to promote heat-transfer to a dramatically high level that has theretofore been considered to be unattainable.

Furthermore, in the example shown above, the main stream of fluid A flows along each of the heat-transfer elements (1), producing only a small amount of branch stream that passes through-holes (13).

In other words, in one cycle of bends in each heat-transfer element (1), most of the fluid will flow along one surface of its passage and only a limited portion of the fluid will flow into an adjacent passage through-holes (13). As a result, the main stream of the fluid will flow undeflected along each heat-transfer element.

The same action of mechanism will occur in the next cycle of bends in each heat-transfer element.

With the heat-transfer unit described above, it is anticipated than an optimum configuration will exist for the heat-transfer elements because the heat-transfer characteristics of the unit will vary depending upon various shape parameters associated with the elements such as the ratio of passage (51) to adjacent passage (52) in terms of the area of cross section taken along the line X—X, the diameter of through-hole (13), their relative opening, and the periodicity of cyclic trapezoidal bends.

DISCLOSURE OF THE INVENTION

The present invention is the result of intensive studies conducted with a view to materializing the concept and features of the prior art in the most effective way. The heat exchanger device of the present invention comprises a plurality of heat-transfer elements placed side by side each of which has more than one through-hole and which are cyclically bent in a generally trapezoidal waveform in the direction of the flow of a fluid, the bends in one heat-transfer element being out of phase with those in an adjacent heat-transfer element by one half cycle in such a manner that the main stream of said fluid will flow not through the holes in each of said heat-transfer elements but through the passage formed by adjacent heat-transfer elements. Since a fluid passage is formed between individual trapezoidally bent heat-transfer elements having a plurality of through-holes, with the trapezoidal bends in one heat-transfer element being out of phase with those in a adjacent heat-transfer element by one half cycle, the heat exchanger device of the present invention is capable of attaining a high relative promotion of heat-transfer.

BEST MODE FOR CARRYING OUT THE INVENTION

[FIRST EMBODIMENT]

Figure 1:
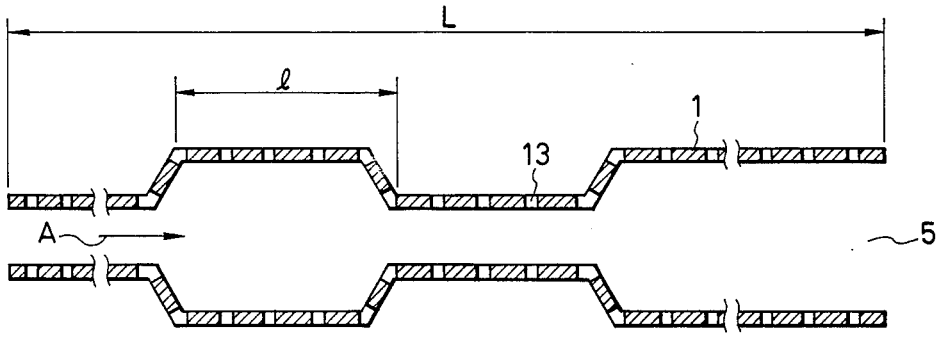
FIG. 1 is a partial cross-sectional perspective view showing a heat-transfer unit according to a first embodiment of the present invention.
Figure 26:
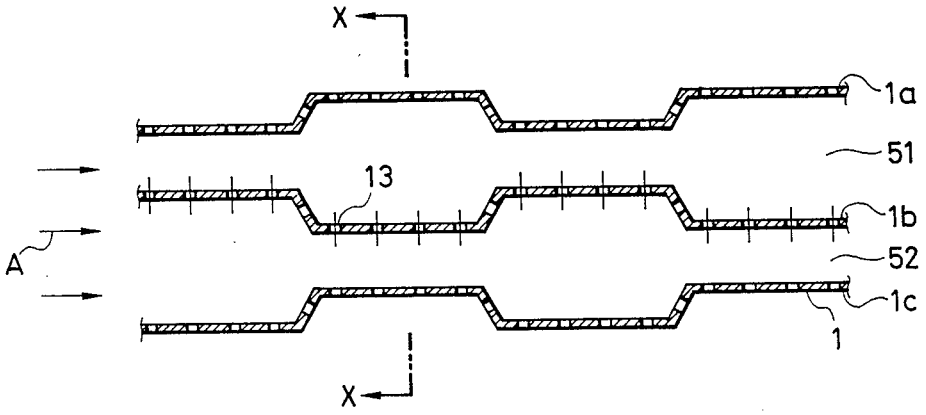
FIG. 26 is a cross section of FIG. 25 taken along the line X—X.

FIG. 1 is a cross-sectional view showing the geometry of a heat-transfer unit according to a first embodiment of the present invention which is shown at an enlarged scale compared with FIG. 26 depicting a prior art heat-transfer unit. In the figure, (1) is a heat-transfer element that is disposed parallel to the direction of fluid flow A and which is provided with a plurality of through-holes (13). The heat-transfer element (1) is cyclically bent in the direction of fluid flow A in the form of trapezoidal waves, and a plurality of such heat-transfer elements are placed side by side in such a manner that the bends in one element are out of phase with those in an adjacent element by one half cycle so as to form a fluid passage (5) between individual heat-transfer elements. The main stream of the fluid flows through this passage (5), with only a small portion of the fluid flowing through the holes (13) as a branch stream.

For the purpose of the following discussion, the projected length of the heat-transfer surface of the heat-transfer element (1) which is in the area corresponding to one half cycle of a series of trapezoidal bends formed in the direction of fluid flow (the projection being made normal to the direction of fluid path) is written as l, and the overall length of the heat-transfer element is written as L. In addition, the width of the larger portion of the fluid passage is written as $A_1$, and that of the smaller portion of the same passage as $A_2$.

First, the periodicity of the trapezoidal forms shown in FIG. 1 is explained. The method of the present invention for achieving accelerated heat-transfer is chiefly based on the heat-transfer promoting effect of uniform sucking and blowing of a fluid but at the same time, the effect of repeated approach zones due to the cyclic changes in the width of the fluid channel are also significant. In other words, the length l rather than the periodicity of trapezoidal forms would cause a predominant effect. Based on this understanding, the present inventors formulated the results of their heat-transfer experiments in terms of l/L, the ratio of length l to the length L of heat-transfer surface.

Figure 2:
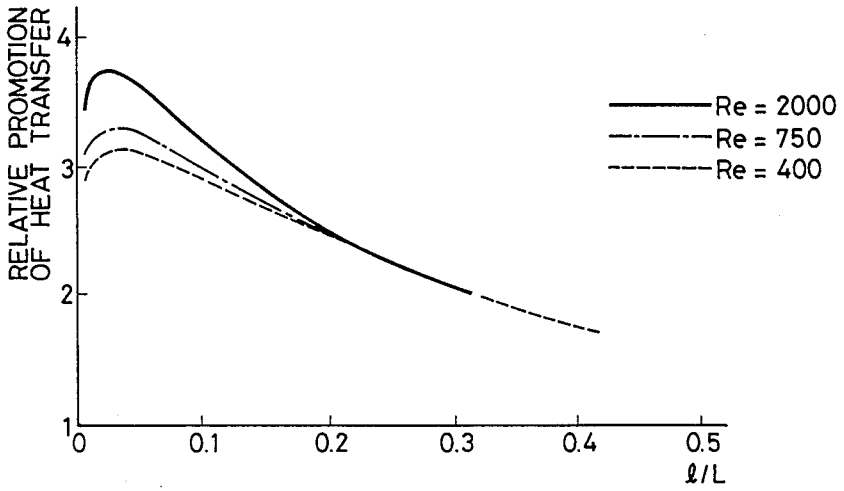
FIG. 2 is a characteristic graph showing the relative promotion of heat-transfer that can be achieved in the first embodiment.

The results of an experiment conducted in air to investigate the relationship between the value of l/L and the relative promotion of heat-transfer are shown in the characteristic diagram of FIG. 2, in which the y-axis represents the relative promotion of heat-transfer and the x-axis the value of l/L with the Reynolds number Re being taken as a parameter.

In FIG. 2, Re (basically representing the magnitude of fluid velocity) is given by:

$$Re = \frac{(A_1 + A_2) \times \text{fluid velocity as defined in terms of } \frac{A_1 + A_2}{2}}{\text{dynamic viscosity coefficient of air}}$$

The relative promotion of heat-transfer, taken against the case of parallel plates in which the heat-transfer unit consists of a plurality of parallel plane plates are arranged together, is given by:

$$\text{Relative promotion of heat-transfer} = \frac{\text{average Nusselt number for the case of interest}}{\text{average Nusselt number for parallel plates}}$$

The average Nusselt number Nu is a dimensionless number that represents heat-transfer rate and is given by:

$$\overline{Nu} = \frac{2 \times (\text{average heat-transfer rate}) \times \frac{(A_1 + A_2)}{2}}{\text{thermal conductivity of air}}$$

As is clear from FIG. 2, the profile of the relative promotion of heat-transfer vs l/L is curved upward and in the range of $l/L < 0.3$, the heat-transfer rate of the system of the present invention is at least twice the value for the parallel plates. This characteristic is substantially independent of the Reynolds number Re, as well as of other shape parameters although not shown in FIG. 2. Therefore, for the purposes of the present invention, l/L is suitably at 0.3 and below.

The following are the dimensional ranges desired for other shape parameters.

diameter of through-hole (13): 0.5—6 mm relative opening of through-hole (13) (area of through-holes relative to the area of an individual heat-transfer element: 0.05–0.40 ratio in cross-sectional area of fluid passage (52) to adjacent passage (51): no more than 0.5 average distance between heat-transfer element (1):

1–2 mm (for small-size unit such as one used for residential air-conditioning)

6—10 mm (for medium-size unit).

The reason for the conclusion stated above with reference to FIG. 2 is that as already mentioned, when the fluid flows from the larger portion of its passage to the smaller portion, the distribution of fluid velocity will become uniform at the entrance of the smaller portion and a temperature boundary layer will restart to develop at that point (a so-called repetition effect of approach zones). As a result, the shorter the length of that portion (i.e, l), the greater the effect for the promotion of heat-transfer.

However, adjustment of l should be made with care; if it is too small, no uniform velocity distribution is attained at the entrance of the smaller portion of a fluid passage and the relative promotion of heat-transfer that can be achieved is decreased rather than increased. In addition, for practical reasons for machining, approximately 3 mm is the lower limit of l.

For attaining an effective and desirable relative promotion of heat-transfer, l/L is suitably no more than 0.3 and in practical situations, is at least 2.5 mm, with the range of from 3 mm up to about 50 mm being desired.

Figure 3:
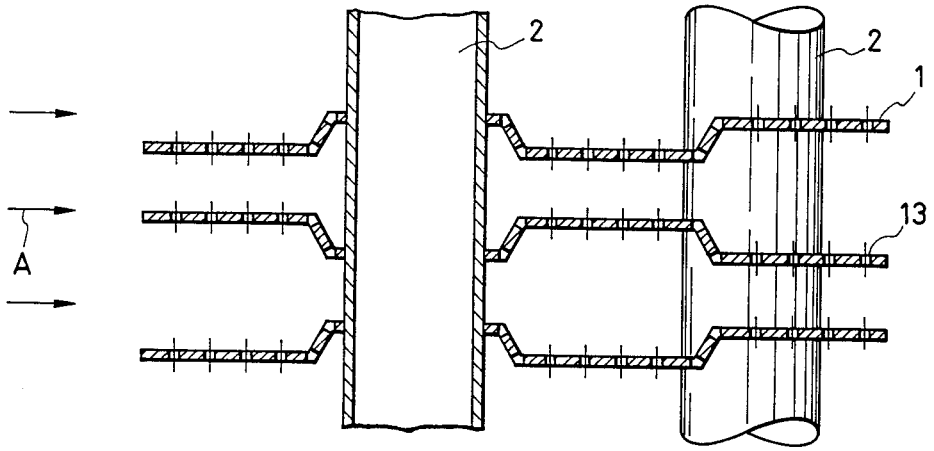
FIG. 3 is a partial cross-sectional view of an arrangement in which the heat-transfer element of FIG. 1 is an arrangement in which the heat-transfer unit.

FIG. 3 is a partial cross-sectional view showing the construction of a heat exchanger device in which the heat-transfer unit (1) is thermally coupled to a second heat-transfer unit (2) having a temperature difference from the unit (1). As shown, the second heat-transfer unit (2) which is in the form of a pipe penetrates the heat-transfer unit (1) and is positioned normal to the direction of fluid flow A. A heat transfer medium flows through the second heat-transfer unit (2). In this case, too, observation set forth in the preceding paragraphs concerning the l/L of the heat-transfer unit (1) will hold good.

[SECOND EMBODIMENT]

Figure 4:
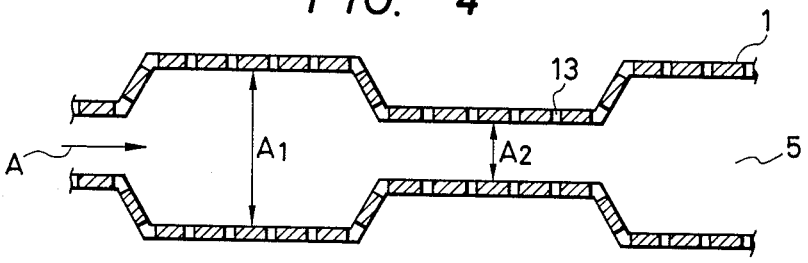
FIG. 4 is a partial cross-sectional view showing a heat-transfer unit according to a second embodiment of the present invention.

FIG. 4 is a cross-sectional view showing the geometry of a heat-transfer unit according to a second embodiment of the present invention. In the figure, (1) is a heat-transfer element that is provided with a plurality of through-holes (13) and which is cyclically bent in the form of generally trapezoidal waves. As in the first embodiment, a plurality of such heat-transfer elements are placed side by side in such a manner that the bends in one element are out of phase with those in a adjacent element by one half cycle so as to form a fluid passage (5) between individual heat-transfer elements. The main stream of the fluid flows through this passage (5), with only a small portion of the fluid flowing through the holes (13) as a branch stream.

As stated above, the heat-transfer unit is so constructed that the generally trapezoidal bends in one heat-transfer element (1) are out of phase with those in an adjacent heat-transfer element by one half cycle, with the result that alternating larger and smaller portions will form in the fluid passage in the direction of fluid flow. For the purpose of the following discussion, the width of the larger portion of the fluid passage is written as $A_1$, and that of the smaller portion of the same passage as $A_2$, with the ratio of $A_2$ to $A_1$ ($A_2/A_1$) being expressed as $\sigma$ ($A_2/A_1$ will be hereinafter denoted by $\sigma$).

As explained in detail in the description of the prior invention, $A_2/A_1$ ($=\sigma$) is none other than a determinant of the cross-sectional area of fluid passages, such as (51) and (52 ) shown in FIG. 26 with reference to the prior art system. According to the present invention, heat-transfer is promoted by the following mechanism: a difference is created between the static pressure in passage (51) and that in passage (52) to cause part of the fluid to flow through-holes (13) so that a thin boundary layer will form in the larger portion of the fluid passage (i.e., the portion of the fluid passage with a larger cross-sectional area), while the repetition effect of approach zones and the movement of fluid bodies will take place in the portion of the fluid passage with a smaller cross-sectional area. Because of these phenomena occurring in the larger and smaller portions of the fluid passage, promotion of heat-transfer is accomplished. Therefore, it can be concluded that $\sigma$ which determines the ratio of the cross-sectional area of the smaller portion of the fluid passage to that of the larger portion, or the ratio of the velocity of fluid flowing in the smaller portion to that of fluid flowing in the larger portion, is the most important factor for determination of heat-transfer characteristics.

In fact, $\sigma=1$ means simple perforated parallel plates (i.e., a plurality of parallel plates placed side by side) which, as shown in connection with the prior invention, basically have no heat-transfer promoting effect. On the other hand, $\sigma=0$ means that one of the two portions of the fluid passage is closed and it is clearly evident that no heat-transfer promoting effect can be anticipated in this case. Therefore, determining an effective value of $\sigma$ is of extreme importance for practical design purposes.

Figure 5:
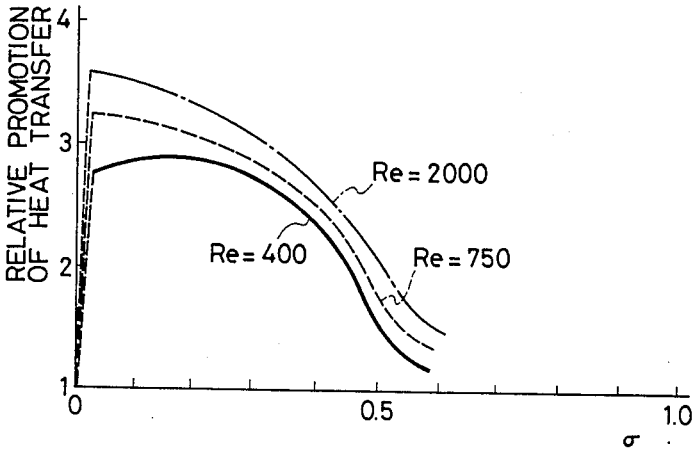
FIG. 5 is a characteristic graph showing the relative promotion of heat-transfer that can be achieved in the second embodiment.

The results of an experiment conducted in air to investigate the relationship between the value of $\sigma$ and the relative promotion of heat-transfer are shown in the characteristic diagram of FIG. 5, in which the y-axis represents the relative promotion of heat-transfer and the x-axis the value of $\sigma$, with the Reynolds number Re being taken as a parameter.

In FIG. 5, Re (basically representing the magnitude of fluid velocity) and the relative promotion of heat-transfer are defined as in the first embodiment, and the average Nusselt Number Nu is a dimensionless number that represents heat-transfer rate and is given by:

$$Nu = \frac{2 \times (\text{average heat-transfer rate}) \times \frac{(A_1 + A_2)}{2}}{\text{heat-transfer rate of air}}.$$

As is clear from FIG. 5, at any value of $\sigma$ that is smaller than 0.5, the heat-transfer rate of the system of the present invention is generally at least twice the value for the parallel plates. This characteristic is independent of the Reynolds number Re, as well as of other shape parameters although not shown in FIG. 5.

The following are the dimensional ranges desired for other shape parameters.

diameter of through-holes (13): 0.05–6 mm relative opening of through-holes (13) (area of through-holes relative to the area of heat-transfer surface): 0.05–0.40 l/L: no more than 0.3 ($l>2.5$ mm)

where l signifies the projected length of heat-transfer element (1) which is in the area corresponding to one half cycle of a series of trapezoidal bends, the projection being made normal to the direction of fluid path, and L is the overall length of the heat-transfer element.

The reason for the conclusion stated above in connection with FIG. 5 is that as already mentioned, if $\sigma$ is great, no effective difference in fluid velocity will be produced between adjacent fluid passages, nor can be attained an effective repetition effect of approach zones.

Therefore, it can be seen from FIG. 5 that in order to attain an effective relative promotion of heat-transfer in an area of single-phase convection with low Re values, $\sigma$ should be desirably smaller than 0.5. As the value of $\sigma$ decreases, the resistance of fluid passage to fluid flow increases, so that for practical purposes, $\sigma$ is desirably no smaller than 0.1. The average spacing between adjacent heat-transfer elements (1) is suitably 1–2 mm (for small-size unit such as one used for residential air-conditioning) and 6–10 mm (for medium-size unit).

In the second embodiment, too, the heat-transfer unit (1) may be thermally coupled, as shown in FIG. 3, to a second heat-transfer unit (2) having a temperature difference from the unit (1) and in this case, the observation set forth above in connection with the $\sigma$ of the heat-transfer unit (1) will also hold good.

[THIRD EMBODIMENT]

Figure 6:
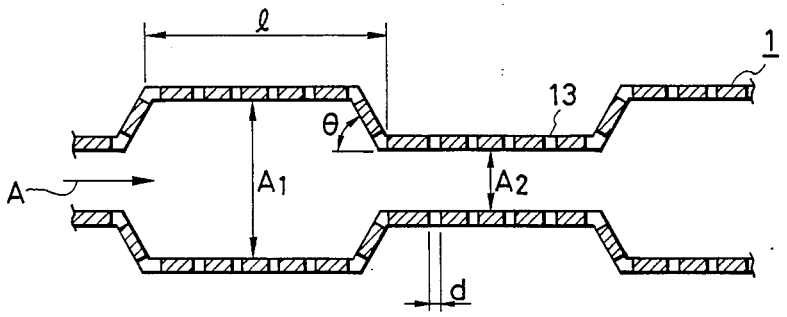
FIG. 6 is a longitudinal section of a heat-transfer unit according to a third embodiment of the present invention.
Figure 25:
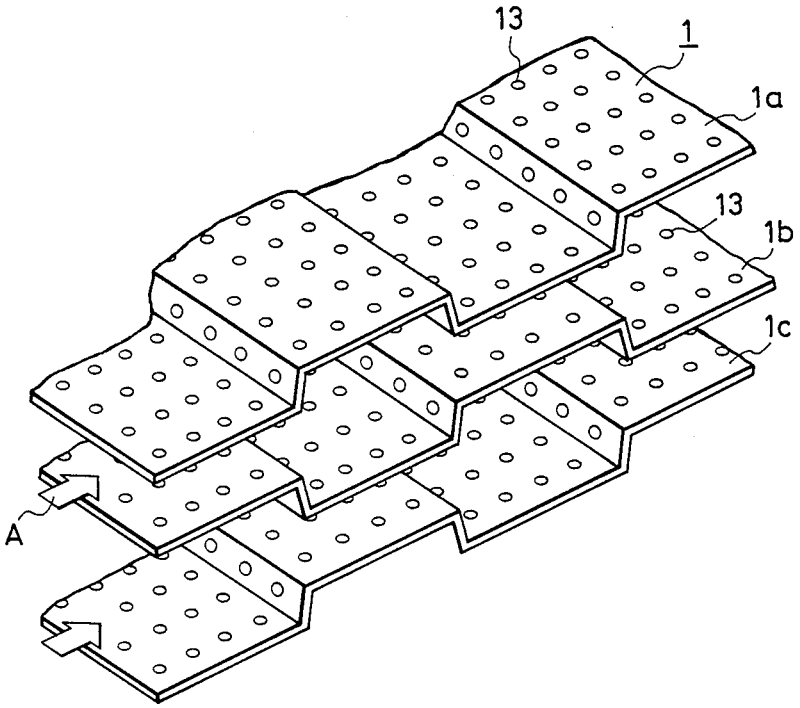
FIG. 25 is a perspective view showing a prior art heat-transfer unit.

FIG. 6 is a longitudinal section of a heat-transfer unit according to a third embodiment of the present invention, with the dimensions of the heat-transfer unit being indicated more specifically than in the previous embodiments. The other aspects of the construction of this heat-transfer unit are the same as shown in FIGS. 25 and 26.

A heat-transfer element (1) is provided with a plurality of through-holes (13 ) and cyclically bent in the form of generally trapezoidal waves. A plurality of such heat-transfer elements are placed side by side in such a manner that the bends in one element are out of phase with those in an adjacent element by one half cycle. For the purpose of the following discussion, the projected length of the heat-transfer surface of the heat-transfer element (1) which is in the area corresponding to one half cycle of a series of generally trapezoidal bends formed in the direction of fluid flow is written as l, and the overall length of the heat transfer element as L. The symbol d signifies the size (diameter) of each of the through-holes (13) formed in the heat-transfer element (1). The relative opening of the through-holes (13), or the proportion of the heat-transfer element (1) taken by the opening of the holes, is written as B although not shown. The angle by which the oblique side of each trapezoidal bend is inclined with respect to the direction of fluid flow is written as $\theta$.

As states above, the heat-transfer unit is so constructed that the generally trapezoidal bends in one heat-transfer element (1) are out of phase with those in an adjacent heat-transfer element by one half cycle, with the result that alternating larger and smaller portions will form in the fluid passage in the direction of fluid flow. For the purpose of the following discussion, the width the larger portion of the fluid passage is written as $A_1$, and that of the smaller portion of the same passage as $A_2$, with the ratio of $A_2$ to $A_1$ ($A_2/A_1$) being expressed as $\sigma$ although not shown in FIG. 6.

In the embodiment shown in FIG. 6, $A_1=3$ mm, $A_2=9$ mm, $l=15$ mm, $L=100$ mm, and $B=12.5\%$.

The outside diameter, d, of each of the through-holes (13) shown in FIG. 6 is explained hereinafter. The method of promoting heat-transfer in the heat-transfer unit of the present invention is largely based on the heat-transfer promoting effect of the static pressure difference that is created between adjacent fluid passages to have part of the fluid flow across a heat-transfer element through-holes (13), and the size, d, of each through-hole (13) would have a strong effect on the characteristics of heat-transfer promotion.

Therefore, the present inventors investigated the relationship between the value of hole diameter, d, and the relative promotion of heat-transfer by experimentation in air. The results of the experiment are shown in FIG. 7.

Figure 7:
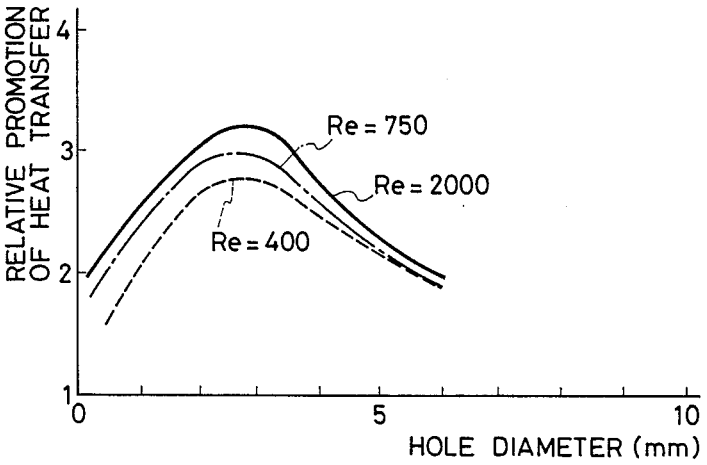
FIG. 7 is a characteristic graph showing the relative promotion of heat-transfer that can be achieved in the third embodiment.

In FIG. 7, the parameter Re is given by:

$$Re = \frac{(A_1 + A_2) \times \left[\text{fluid velocity as defined in terms of } \frac{A_1 + A_2}{2}\right]}{\text{dynamic viscosity coefficient of air}}.$$

The y-axis in FIG. $\beta$ represents the relative promotion of heat-transfer, which is defined as:

$$\text{Relative promotion of heat-transfer} = \frac{\text{average Nusselt number for the case of interest}}{\text{average Nusselt number for parallel plates}}.$$

The average Nusselt number e,ovs/Nu/ is a dimensionless number that represents heat-transfer rate and is given by:

$$\overline{Nu} = \frac{2 \times (\text{average heat-transfer rate}) \times \frac{(A_1 + A_2)}{2}}{\text{thermal conductivity of air}}.$$

The characteristic shown in FIG. 7 is substantially independent of Re (basically representing the magnitude of fluid velocity), as well as of other shape parameters although not shown in FIG. 7.

According to the experiment conducted by the present inventors, characteristics similar to that shown in FIG. 7 were obtained when the relative opening of through-holes (13) was in the range of 0.05–0.3, l/L 0.3 or below, and $A_2/A_2$ 0.5 or below.

According to FIG. 7, the profile of the relative promotion of heat-transfer vs diameter, d, is curved upward and in the range of d=0.5–6.0, the heat-transfer rate of the system of the present invention is at least twice the value for the parallel plates.

This would be explained as follows: even if the relative opening of through-holes (13) is constant, each heat-transfer element (1) has a finite plate thickness as shown in FIG. 6, and as the hole diameter, d, decreases, the resistance of through-holes (13) to fluid flow increases to such an extent that given a constant static pressure difference between adjacent fluid paths, a smaller amount of fluid will flow through-holes (3) to cause a corresponding decrease in the relative promotion of heat-transfer; on the other hand, if the hole diameter, d, increases to a certain degree, the resistance to fluid flow of through-holes (13) having a constant value of their relative opening will remain constant, but if the value of, d, increases progressively, the pitch or the spacing of adjacent through-holes (13) also increases and the concept of uniform fluid sucking described in connection with the prior art will no longer apply with a subsequent drop in the relative promotion of heat-transfer. For these two reasons, there would be an appropriate value for the diameter, d, of an individual through-hole.

In other words, it can be seen that for attaining an effective relative promotion of heat-transfer, the diameter of through-holes, d, should desirably be within the range of 0.5–6.0 mm.

Even in the case of through-holes (13) which are not circular in cross section, it goes without saying that comparable results will be attained if the area of such non-circular holes is within the range of areas that have equivalent diameters within the above-specified range.

[FOURTH EMBODIMENT]

Figure 8:
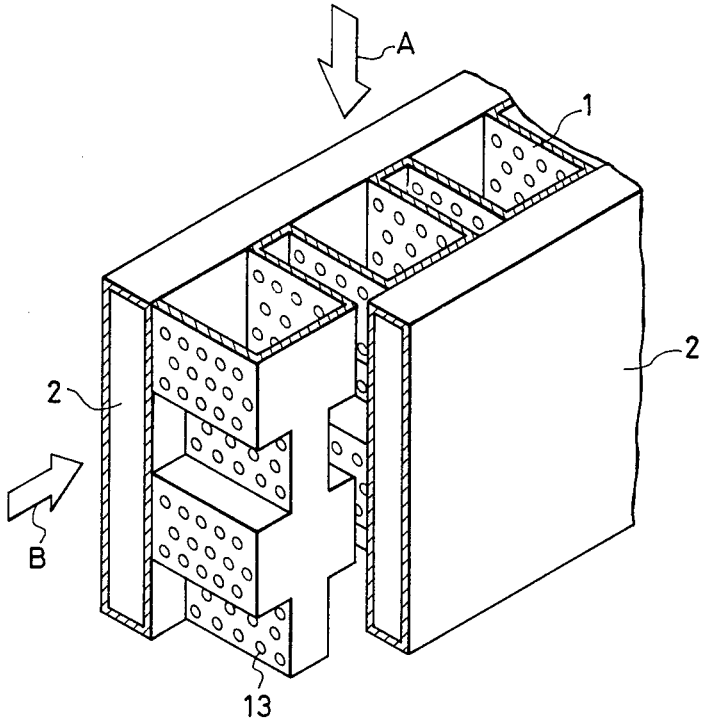
FIG. 8 is a partial cutaway view of a heat-transfer unit according to a fourth embodiment of the present invention.

FIG. 8 is a partial cutaway view of a heat exchanger according to a fourth embodiment of the present invention which is a corrugated fin type heat exchanger commonly used as a radiator in such applications as automobiles. In FIG. 8, (1) is a first heat-transfer unit of the same type as used in the previous embodiments which consists of a plurality of heat-transfer elements each of which has more than one through-hole (13) and which are cyclically bent in a generally trapezoidal waveform in the direction of the flow of a secondary fluid A such as air, the bends in one heat-transfer element being out of phase with those in an adjacent heat-transfer element by one half cycle, and (2) is a second heat-transfer unit that has a temperature difference from the first heat-transfer unit (1) and which is in the form of a water pipe through which a primary fluid B such as engine cooling water flows. The first heat-transfer unit (1) is thermally coupled to the second heat-transfer unit (2) so that heat exchange will take place between the primary fluid B and the secondary fluid A.

The present invention can also be applied to a plate fin type heat exchanger for use in air-conditioning. In this case, as shown in FIG. 3, a pipe serving as the second heat-transfer unit (2) passes through the first heat-transfer unit (1) of the same type as used in the previous embodiments and is positioned normal to the direction of the flow of fluid A.

In the heat exchanger of the type shown in FIG. 8, the second heat-transfer unit (2) through which the primary fluid B flows generally has good heat-exchanging characteristics because water is typically used as the primary fluid B, and it is the heat-transfer fins, or the first heat-transfer unit (1) through which the secondary fluid A such as air flows, that are desired to be improved in terms of heat-transfer characteristics. Heat exchangers having improved characteristics in this respect can be attained by employing an arrangement that is the same as used in the previous embodiments of the present invention and in which the diameter of through-holes (13) is also selected at an appropriate value within the range of 0.5–6.0 mm.

[FIFTH EMBODIMENT]

A fifth embodiment of the present invention is hereunder described. This embodiment is characterized in that the relative opening, $\beta$, of through-holes (13) shown in FIG. 6, or the proportion of the heat-transfer element (1) taken by the opening of these holes, is limited to be within the range of 0.05–0.3. The method of the present invention for achieving accelerated heat-transfer is largely based on the heat-transfer promoting effect of the static pressure difference that is created between adjacent fluid paths to have part of the fluid flow across a heat-transfer element through-holes (13) and, in this sense, the relative opening $\beta$ of through-holes (13) is a factor that directly governs the volume of fluid flow. Therefore, it is assumed that $\beta$ will have a very great effect on the characteristics of heat-transfer promotion.

Figure 9:
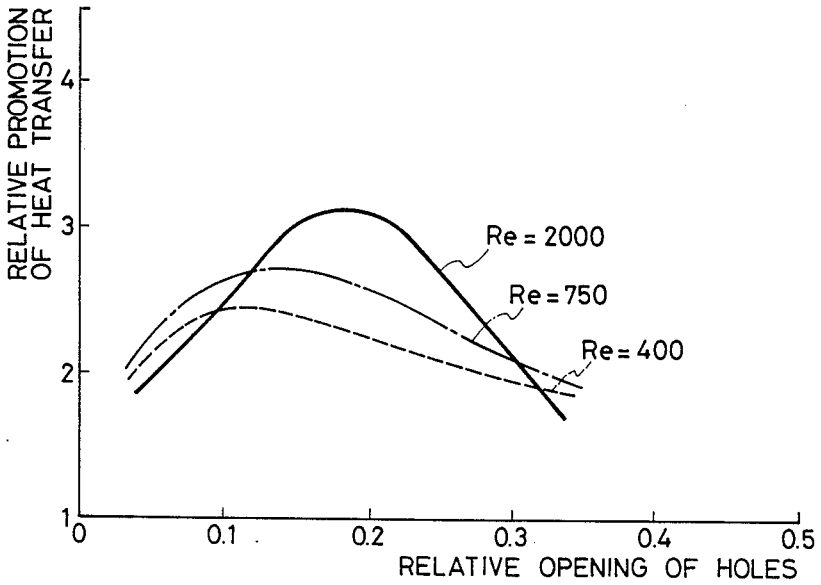
FIG. 9 is a characteristic graph showing the relative promotion of heat-transfer that can be achieved by a heat-transfer unit according to a fifth embodiment of the present invention.

The results of an experiment conducted in air to investigate the relationship between the value of $\beta$ and the relative promotion of heat-transfer are shown in FIG. 9.

In FIG. 9, the parameter Re is given by:

$$Re = \frac{(A_1 + A_2) \times \left[\text{fluid velocity as defined in terms of } \frac{(A_1 + A_2)}{2}\right]}{\text{dynamic viscosity coefficient of air}}$$

and the results for Re =400, 750, and 2,000 are depicted. The y-axis in FIG. 9 represents the relative promotion of heat-transfer with the loss of heat-transfer area due to through-holes being taken into account and is given by:

$$\text{Relative promotion of heat-transfer} = \frac{\text{average Nusselt number for the case of interest}}{\text{average Nusselt number for parallel plates}} \times (1 - \beta).$$

The average Nusselt number $\overline{Nu}$ is a dimensionless number that represents heat-transfer rate and is given by:

$$Nu = \frac{2 \times (\text{average heat-transfer rate}) \times \frac{(A_1 + A_2)}{2}}{\text{thermal conductivity of air}}.$$

The characteristics shown in FIG. 9 is substantially independent of Re (basically representing the magnitude of fluid velocity), as well as of other shape parameters although not shown in FIG. 9.

According to FIG. 9, the profile of the relative promotion of heat-transfer vs relative opening $\beta$ is curved upward and in the vicinity of $\beta$=0.05–0.30, the heat-transfer rate of the system of the present invention is at least twice the value for the parallel plates, with a maximum being in the vicinity of 0.05–0.2.

This would be explained as follows.

Although not shown in FIG. 9, if the relative promotion of heat-transfer is evaluated without taking into account the loss of heat-transfer area due to the presence of through-holes (13), it increases gradually as the relative opening, 8, and hence the volume of fluid flow through-holes (13), increases.

However, the increase in relative opening $\beta$ results in the decrease in heat-transfer area and evaluation of relative promotion of heat-transfer taking this loss of heat-transfer area into account provides the result shown in FIG. 9.

The profile of relative promotion of heat-transfer shown in FIG. 9 is the one which is observed in practical operations, so it can be seen that for achieving effective relative promotion of heat-transfer, the relative opening $\beta$ is desirably within the range of 0.05–0.3, with the range of 0.05–0.2 being particularly desirable. Needless to say, completely the same results will be attained even if the through-holes (13) have noncircular cross-sectional forms such as rectangles.

The following are the dimensional ranges desired for other shape parameters.

diameter, d, of through-hole (13): 0.5–6 mm l/L: no more than 0.3 (l>2.5 mm)

where l signifies the projected length of heat-transfer element (1) which is in the area corresponding to one half cycle of a series of trapezoidal bends, the projection being made normal to the direction of fluid path, and L is the overall length of the heat-transfer element.

ratio in cross-sectional area of the smaller portion of a fluid passage to the adjacent larger portion: no more than 0.5 average distance between adjacent heat-transfer elements (1), (1):

1–2 mm (for small-size unit)

6–10 mm (for medium-size unit).

[SIXTH EMBODIMENT]

The following is the description of a sixth embodiment of the present invention in which the heat-transfer unit is constructed as a plate fin tube type heat exchanger.

The general construction of a plate fin tube type heat exchanger is such that a plurality of heat-transfer pipes are passed through a plurality of plate fins placed side by side, the pipes being disposed perpendicular to the fins and held in intimate contact therewith by such means as flared pipes. A primary fluid such as cold water, warm water or coolant is caused to flow through the heat-transfer pipes and a secondary fluid such as air is passed between the fins so as to effect heat exchange between the two fluids.

When an air stream flows between the fins, a hydrodynamic boundary layer is highly likely to develop along the fins. The temperature gradient in this boundary layer is extremely high and this means that the boundary layer portion presents a great heat resistance. The thickness of the boundary layer increases in the direction of the flow of secondary fluid and this causes a significant drop in the heat-transfer rate of the portion of the fins which is downstream in the direction of fluid flow.

Therefore, the biggest problem with the plate fin tube type heat exchanger is the low heat-transfer rate between streams of the secondary fluid (on the fin side), and in order to improve this heat-transfer rate, it is effective to prevent the formation and development of the boundary layer described above.

Figure 10:
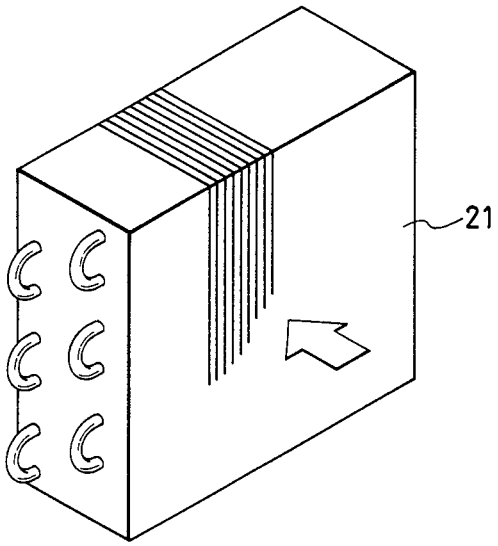
FIG. 10 is a perspective view of a plate fin tube type heat exchanger.
Figure 11:
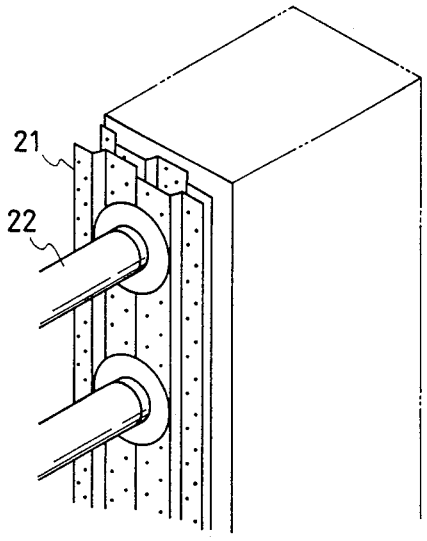
FIG. 11 is a perspective view showing the essential part of this heat exchanger.
Figure 12:
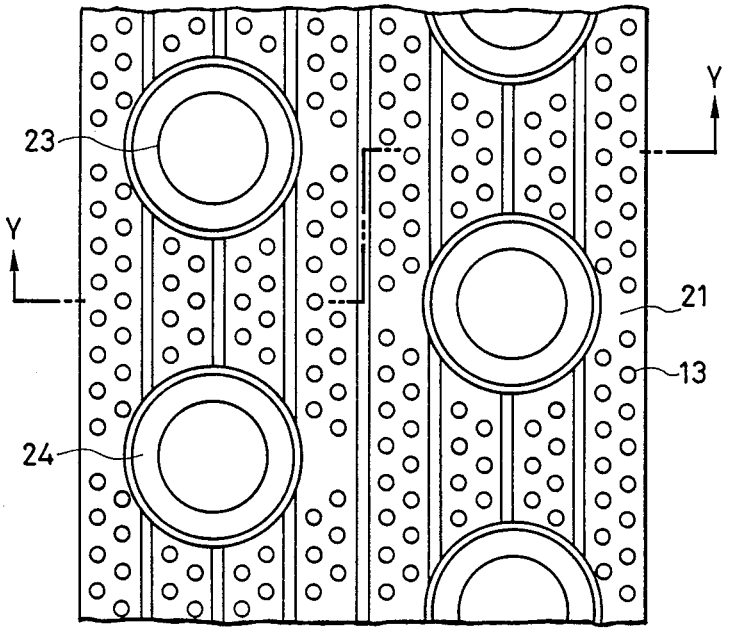
FIG. 12 is a plan view of a heat-transfer unit according to a sixth embodiment of the present invention.

FIG. 10 is a perspective view of a plate fin tube type heat exchanger according to a sixth embodiment of the present invention; FIG. 11 is a partially enlarged perspective view of FIG. 10; FIG. 12 is a plan view of one of the plate fins shown in FIG. 11; and FIG. 13 is a cross section of FIG. 12 taken along the line Y—Y.

As shown in FIGS. 10 and 11, the plate fin tube type heat exchanger is composed of a plurality of fin substrates (21) spaced parallel to each other, and a plurality of heat-transfer pipes (22) inserted into these fin substrates (21) normal thereto. An air stream flows between fin substrates (21) in the direction indicated by the arrow. The details of fin substrates (21) are shown in FIGS. 9 to 11, with a plurality of holes (23) into which the heat-transfer pipes are inserted being formed in each fin substrate (21) having an overall length L in the direction of fluid path.

Figure 13:
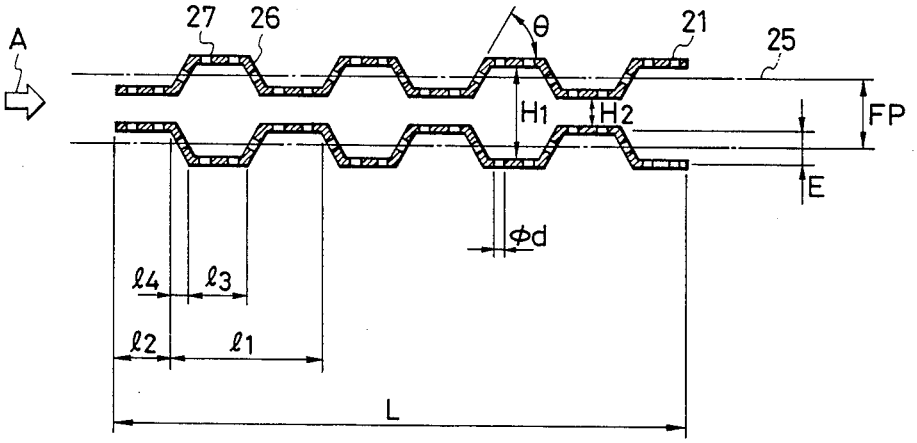
FIG. 13 is a cross section of FIG. 12 taken along the line Y—Y.
Figure 14:
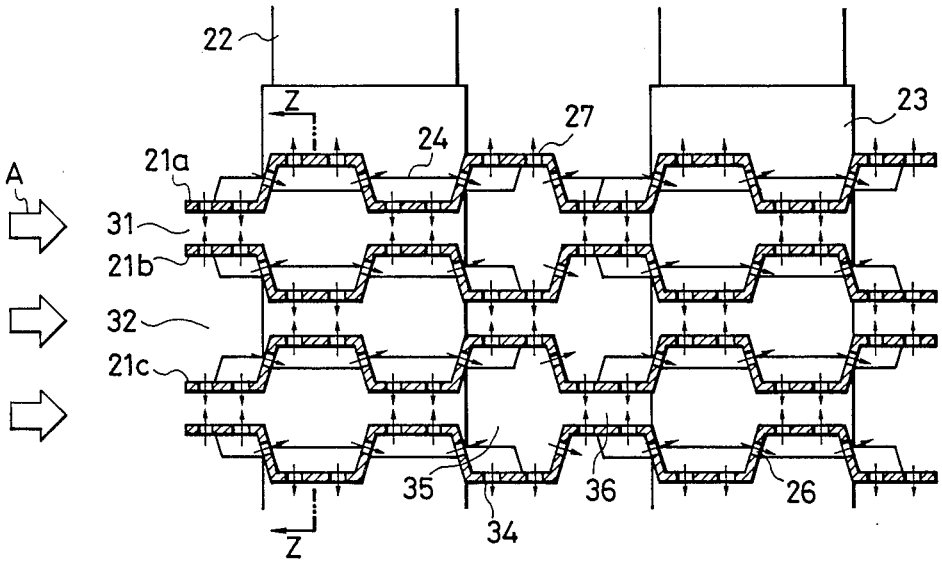
FIG. 14 is a cross-sectional view of an arrangement in which a plurality of fin substrates of the type shown in FIG. 12 are stacked one on another.

FIG. 14 shows the details of a partial cross section of a heat exchanger in which a plurality of the fin substrates (21) shown in FIGS. 12 and 13 are stacked one on top of another. Each of the fin substrates (21) is provided with a plurality of through-holes (13) and cyclically bent in the form of trapezoidal waves in the direction of air flow A indicated by the arrow.

Each of the fin substrates (21) is joined to the heat-transfer pipe (22) by a fin collar portion (23), and the riser portion (24) of the fin collar portion (23) is situated on the center line (25) of a trapezoidal bend in the direction of its height, with no through-hole (13) being present in the riser portion (24) of the fin collar. The numeral (26) denotes the shoulder of the trapezoidally bent fin substrate (21). The heat exchanger is constructed by stacking a plurality of fin substrates (21) one on top of another in such a manner that the bends in one fin are out of phase with those in an adjacent fin by one half cycle.

In FIG. 13, the overall length of the fin substrate (21) in the direction of air flow A is written as L, the length of one cycle of trapezoidal bends as $l_1$, the distance from an end of the fin substrate (21) to the shoulder (26) of the first occurring trapezoidal bend as $l_2$, the length of the flat portion (27) of a trapezoidal bend as $l_3$, the dimension of the shoulder (26) of the trapezoidal bend in the direction of air flow as $l_4$, the angle of inclination of the shoulder as $\theta$, the dimension of the trapezoidal bend in the direction of its height as E, the distance between the center lines (25) in the direction of the height of the trapezoidal bends in adjacent fin substrates (21) as EP, the distance between adjacent fin substrates (21) in the larger portion (35) of a fluid passage as $H_1$, the distance between adjacent fin substrates (21) in the smaller portion (36) of the same fluid passage as $H_2$, and the diameter of an individual through-hole (13) as d.

The dimension EP is equivalent to the height of the fin collar portion (23). This is one of the features of plate fin tube type heat exchangers for use in air-conditioners to which the present invention is to be applied, and the height of the fin collar portion (23) will determine the dimension of EP, or fin pitch.

The constitutional dimensions listed above are set within the following ranges: $\sigma=H_2/H_1=0.15$–$0.45$ [$\sigma$ is expressed as $H_2/H_1$, or the ratio of $H_2$ which is the distance between adjacent fin substrates (1) in the smaller portion (36) of a fluid passage to $H_1$ which is the distance between adjacent fin substrates (21) in the larger portion (35) of the same passage, and signifies the ratio of the cross-sectional area of the smaller portion (36) to that of the larger portion (35)]; $EP=1.5$–$3.0$ mm; $\beta=0.025$–$0.3$ [$\beta$ is the relative opening of through-holes (13), or the ratio of the total area of these through-holes to the area of the fin substrate (21) except for the portions where heat-transfer pipes (22) are inserted]; $d=0.5$–$3.0$; as for $l_3$, or the dimension of the flat portion (27) of an individual trapezoidal bend, $(L/NR)/C=2$–$6$, $(L/NR)/C$ expressing the number of trapezoidal bends repeated in one row of heat-transfer pipes that cross the air flow A at right angles and relating NR (the number of such rows) to L, or the overall length of the fin substrate (21) in the direction of air flow; and $\theta=45°$–$65°$.

The action of mechanism of the plate fin tube type heat exchanger having the construction specified above is hereinafter explained.

In FIG. 14, the fluid passage formed between fins (21*a*) and (21*b*) is a first passage and indicated by (31), and the passage formed between (1*b*) and (1*c*) is a second passage and denoted by (32). If it is assumed that the same volume of air flows in the two passages (31) and (32 ) under the same total pressure, the velocity of the air flowing in the first passage (31) through a cross section taken along the line Z—Z normal to the direction of air flow A is smaller than the velocity of the air flowing in the second passage (32) through a smaller cross section that is also taken along the line Z—Z. Because of the resulting difference that occurs between the static pressure in the first passage (31) and that in the second passage (32), a branch stream (34) will flow from the first passage (31) into the second passage (32) through-holes (13).

As a result, very thin boundary layers form on heat-transfer surfaces where uniform fluid sucking occurs and this provides dramatic improvement in the promotion of heat-transfer. High heat-transfer performance is also attained on surfaces of uniform fluid blowing because of the repetition effect of approach zones.

A further advantage of the system of the present invention is that because of the presence of trapezoidal fins, fin substrates (21) have increased strength and can be easily assembled into a heat exchanger.

The following is the advantage that results when $\sigma(=H_2/H_1)$ is set to be within the range of 0.15–0.45, assuming that $\sigma$ which is expressed as $H_2/H_1$, or the ratio of $H_2$ which is the distance between adjacent fins in the smaller portion (36) of a fluid passage to $H_1$ which is the distance between adjacent fins in the larger portion (35) of the same passage, signifies the ratio of the cross-sectional area of the smaller portion (36) to that of the larger portion (35).

As already mentioned, in the system of the present invention, the larger portion (35) of a fluid passage cyclically alternates with the smaller portion (36) of the same passage between adjacent fins, so that very thin boundary layers will form on the flat portion (27) of the trapezoidal bend in the larger portion (35) of the fluid passage (i.e., the fluid-sucking surface) while in the flat portion of the trapezoidal bend in the smaller portion (36) of the same passage (i.e., the fluid-blowing surface), the repetition effect of approach zones materializes to provide a significant improvement in heat-transfer performance.

Figure 15:
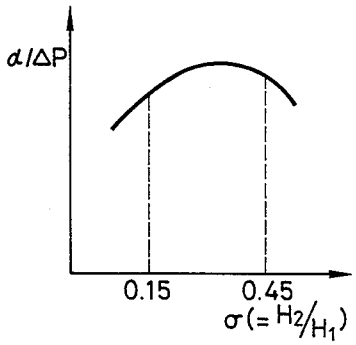
FIGS. 15 and 16 are each a characteristic graph showing the ratio of outside-tube heat-transfer coefficient to wind pressure loss for the sixth embodiment.

It can be seen from FIG. 15 that if $\sigma=0.15$–$0.45$, $\alpha/\Delta P$, or the ratio of outside-tube heat-transfer rate $\alpha$ to wind pressure loss $\Delta P$, which is one of the important factors for characterization of the performance of a heat exchanger becomes the highest for the same wind velocity. This would be explained as follows: if $\sigma$ is small, the difference between static pressure in the larger portion (35) of a fluid passage and that in the smaller portion (36) of the same passage increases to promote the heat transfer on the fluid-sucking surface and hence, the outside-tube heat-transfer rate $\alpha$, but at the same time, the resulting wind pressure loss is greater than the increase in $\alpha$, thereby causing a decrease in $\alpha/\Delta P$. This is ascribable to the loss of fluid flow occurring in the smaller portion (36) of the fluid passage and to the increase in shape resistance resulting from the cyclic change in the width of the fluid passage.

If $\sigma$ is large, the above-mentioned wind pressure loss is decreased but on the other hand, the heat-transfer effect on the fluid-sucking surface, which is generally referred to as the breathing effect, cannot be fully utilized to provide improved heat-transfer performance.

The following is the advantage that results when EP is set to be within the range of 1.5–3.0, EP being the fin pitch (as defined above) which is the distance between the center lines (25) in the direction of the height of the trapezoidal bends in adjacent fins.

Figure 16:
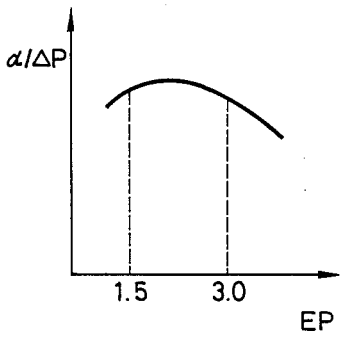

As already mentioned, in the system of the present invention, the larger portion (35) of a fluid passage cyclically alternates with the smaller portion (36) of the same passage between adjacent fins, so that very thin boundary layers will form on the flat portion (27) of the trapezoidal bend in the larger portion (35) of the fluid passage (i.e., fluid-sucking surface) while in the flat portion of the trapezoidal bend in the smaller portion (36) of the same passage (i.e., the fluid-blowing surface), the repetition effect of approach zones materializes to provide a significant improvement in heat-transfer performance. It can be seen from FIG. 16 that if $EP=1$-.5–3.0 mm for a constant value of $\sigma$, $\alpha/\Delta P$, or the ratio of outside-tube heat-transfer rate $\alpha$ to wind pressure loss $\Delta P$, which is one of the important factors for characterization of the performance of a heat exchanger becomes the highest for the same wind velocity.

If the fin pitch (EP) is decreased with $\sigma$ being held constant, $H_2$, or the distance between fins in the smaller portion (36) of a fluid passage, becomes so small as to cause a sudden increase in the loss of fluid flow with the eventual result that $\alpha/\Delta P$ (the ratio of outside-tube heat-transfer rate to wind pressure loss) is reduced. An additional problem with this case where $H_2$ is very small is that the trouble of one fin sticking to another is highly likely to occur when fin substrates are assembled into a heat exchanger.

If the fin pitch (EP) is increased with $\sigma$ being held constant, the proportion of the main stream of air flowing between fins taken by the branch stream (34) of air flowing through-holes (13) is decreased, with the result that the amount of improvement in heat-transfer performance due to the breathing effect (viz., thin boundary layers form on the fluid-sucking surfaces) is reduced.

Figure 17:
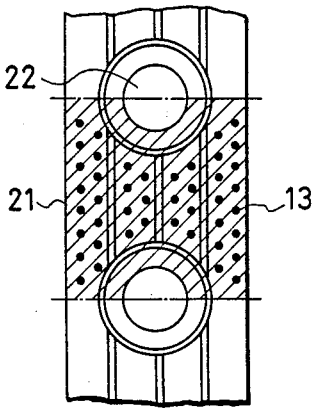
FIG. 17 is an illustration of the relative opening of through-holes.

The following is the advantage that results when $\beta=0.025$–$0.3$, $\beta$ being the relative opening of through holes (13), or the ratio of the total area of these through-holes to the area of the fin substrate (21) except for the portions where heat-transfer pipes (22) are inserted (the latter area being hatched in FIG. 17).

Figure 18:
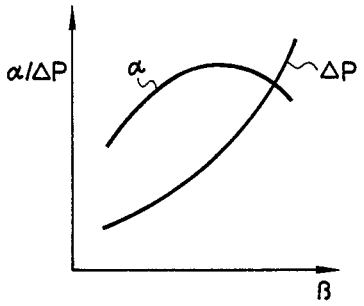
FIGS. 18 to 22 are characteristic graphs showing the ratio of outside-tube heat-transfer coefficient to wind pressure loss as related to four different parameters.

With the wind velocity being the same, the outside-tube heat-transfer rate which is one of the important factors for characterization of the performance of a heat exchanger, and the wind pressure loss $\Delta P$ vary as depicted in FIG. 18.

Figure 19:
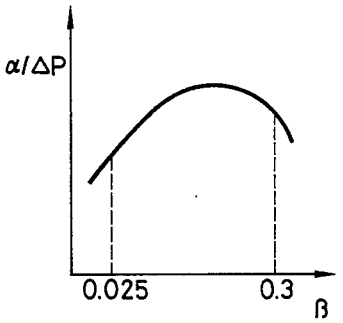

In other words, $\alpha/\Delta P$, or the ratio of outside-tube heat-transfer rate to wind pressure loss, varies as shown in FIG. 19 and a maximum value of $\alpha/\Delta P$ is achieved in the range of $\beta$32 0.025–0.3.

This is explained as follows: when $\beta$ is small, the amount of the branch stream (34) of air passing through-holes (13) in the fluid-sucking surface is reduced, thereby causing a drop in heat-transfer performance; when $\beta$ is large, the total area of the through-holes (13) is increased to reduce the fin efficiency and hence the heat-transfer promoting effect. Furthermore, the fin strength decreases if $\beta$ is large.

Figure 20:
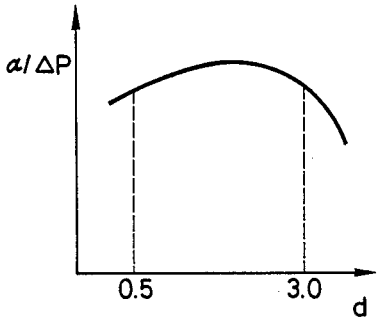

If the outside diameter of through-holes (13) is set to be within the range of $d=0.5$–$3.0$ mm, it can be seen from FIG. 20 that this is the range where $\alpha/\Delta P$, or the ratio of outside-tube heat-transfer rate $\alpha$ to wind pressure loss $\Delta P$, which is one of the important factors for characterization of the performance of a heat exchanger becomes the highest for the same wind velocity.

This is explained as follows: if the hole diameter d is small, the resistance coefficient of the fluid-sucking surface is increased while the amount of branch stream (34) is decreased so as to cause a drop in heat-transfer performance; if the hole diameter is within the range of $d=0.5$–$3.0$, $\alpha/\Delta P$ will not vary greatly but if d is more than 3.0 mm, the fin efficiency and hence the heat-transfer performance is decreased. The machined surface has a constant value of the relative opening $\beta$, and if the hole diameter d is decreased, the size of a press for making through-holes (13) is increased while the fin strength is decreased if the hole diameter d is increased.

The following is the advantage that results when $(L=NR)/A$ is set to be within the range of 2–6, assuming that $(L=NR)/A$ which expresses the number of trapezoidal bends repeated in one row of heat-transfer pipes that cross the direction of air flow at right angles, correlates $l_3$ (the length of the flat portion of a trapezoidal bend) and NR (the number of the rows of trapezoidal bends) to L (the overall length of the fin substrate (21) in the direction of air flow).

Figure 21:
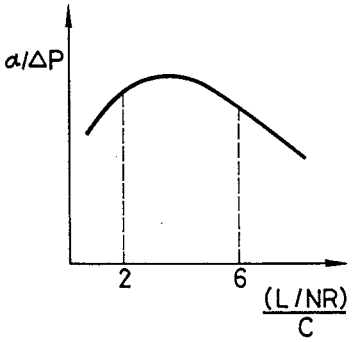

If the number of trapezoidal bends repeated in one row of heat-transfer pipes is set to be within the range of $(L/NR)/A=2$–6, it can be seen from FIG. 21 that this is the range where $\alpha/\Delta P$, or the ratio of outside-tube heat-transfer rate to wind pressure loss $\Delta P$, which is one of the important factors for characterization of the performance of a heat exchanger becomes the highest for the same wind velocity.

This is explained as follows: if $l_3$ or the length of the flat portion of a trapezoidal bend is decreased with L or the overall length of the fin in the direction of air flow being held constant, the number of the alternating larger and smaller portions of a fluid passage is increased so as to provide improved heat-transfer performance by the combination of the sucking effect on the fluid-sucking surface and the repetition effect (of approach zones) but at the same time, the resulting wind pressure loss is greater than the increase in $\alpha$, thereby causing a decrease in $\alpha/\Delta P$. This increase in wind pressure loss is ascribable more to the loss of fluid flow produced by a shorter cycle for renewing the approach zones than to the increase in shape resistance resulting from the cyclic change in the width of the fluid passage.

If the length ($l_3$) of the flat portion of a trapezoidal bend is increased with L (the overall length of the fin in the direction of air flow) being held constant, the number of the alternating larger and smaller portions of a fluid passage is decreased to provide reduced heat-transfer performance.

The following is the advantage that results when the angle of inclination formed between the shoulder (26) of a trapezoidal bend and the fin substrate (21) is set to be within the range of 25°–60°.

Figure 22:
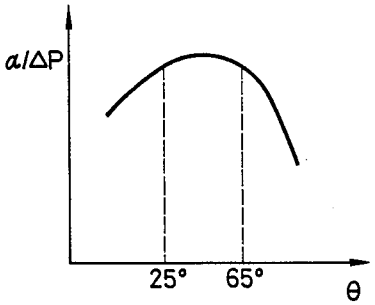

If $\theta$ is in the range of 45°–65°, it can be seen from FIG. 22 that this is the range where $\alpha/\Delta P$, or the ratio of outside-tube heat-transfer rate $\alpha$ to wind pressure loss $\Delta P$, which is one of the important factors for characterization of the performance of a heat exchanger becomes the highest for the same wind velocity.

This is explained as follows: if the angle $\theta$ is small, the dimension E of a trapezoidal bend taken in the direction of its height becomes smaller than the thickness of a temperature boundary layer formed in the direction of incidence of an air stream, and the repetition effect (of approach zones) will not be fully utilized to ensure improved heat-transfer characteristics; if the angle $\theta$ is large, the heat-transfer performance will not be greatly improved and instead the wind pressure loss will increase to cause a drop in the characteristics of the system as a heat exchanger. Another problem associated with the large value of $\theta$ is that it impairs structural integrity by increasing the chance of the formation of defective fins during their molding.

Figure 23:
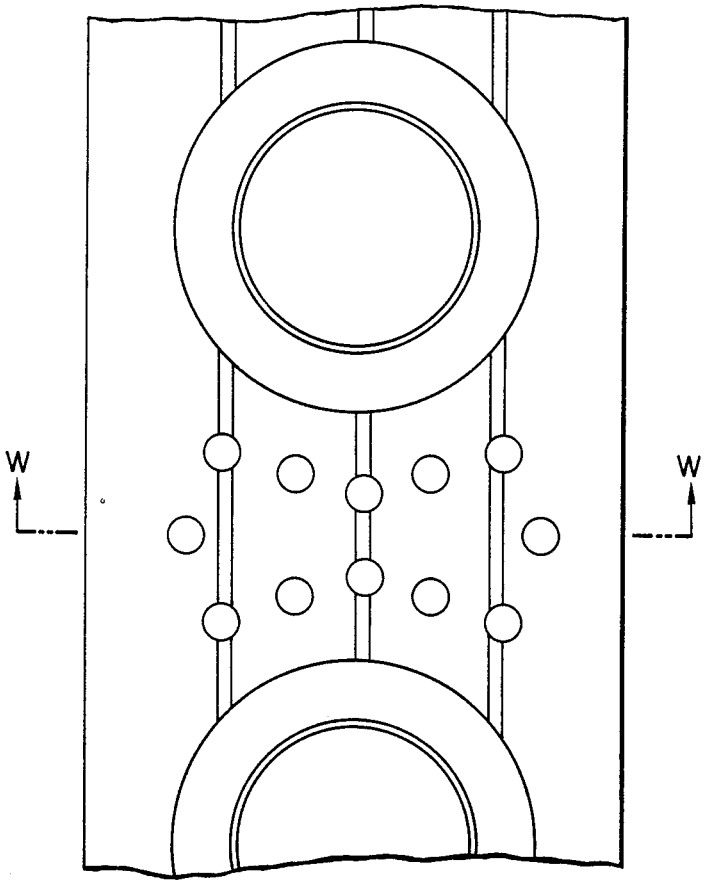
FIG. 23 is a drawing illustrating the effect of the angle of inclination of oblique surfaces in a fin substrate.
Figure 24:
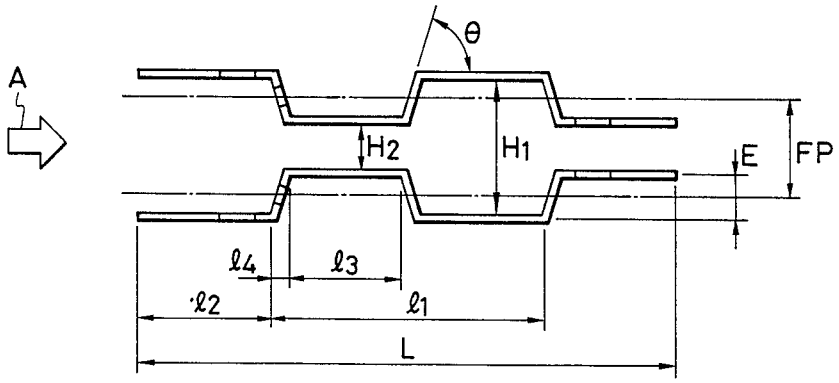
FIG. 24 is a cross section of FIG. 23 taken along the line W—W.

The following is the advantage that results when through-holes (13) are located in the shoulder (26) of a trapezoidal bend as shown in FIG. 23.

The through-holes (13) formed in the shoulder (26) of a trapezoidal bend chiefly govern the loss of fluid flow whereas the through-holes (13) in the flat portion (27) of the trapezoidal bend serve to improve heat-transfer performance. Therefore, if through-holes (13) are located in the shoulder (26) of the trapezoidal bend, there will be no substantial change in heat-transfer performance for the same value of relative opening and instead, the wind pressure loss will be decreased to achieve a consequential improvement in $\alpha/\Delta P$, or the ratio of outside-tube heat-transfer rate to wind pressure loss. The reason for this decrease in the loss of fluid flow is that air flows into the larger portion of a fluid passage on the downstream side through such holes (13) in the shoulder (26) of the trapezoidal bend so as to decrease the fluid velocity in the smaller portion of the same passage.

It should be noted that the fin substrate (21) and the heat-transfer pipe (22) described in connection with the sixth embodiment correspond to the heat-transfer unit (1) and the second heat-transfer unit (2), respectively, in the first to fifth embodiments of the present invention.

[ADVANTAGES OF THE INVENTION]

As described in the foregoing, according to the present invention, a plurality of heat-transfer elements each having more than one through-hole and which are cyclically bent in a generally trapezoidal waveform in the direction of a fluid are placed side by side in such a manner that the bends in one heat-transfer element will be out of phase with those in an adjacent heat-transfer element and that the main stream of said fluid will not flow through the holes in each of said heat-transfer elements but through the passage formed by adjacent heat-transfer elements. This arrangement is effective in providing improved heat-transfer characteristics.

What is claimed:

1. A heat exchanger comprising a plurality of heat-transfer elements placed side by side each of which has more than one through-hole and which are cyclically bent in a generally trapezoidal waveform in the direction of the flow of a fluid, the bends in one heat-transfer element being out of phase with those in an adjacent heat-transfer element by one half cycle in such a manner that the main stream of said fluid will flow not through the holes in each of said heat-transfer elements but through the passage formed by adjacent heat-transfer elements.

2. A heat exchanger—according to claim 1 wherein l/L is set to a value of no more than 0.3, l being the projected length of a heat-transfer element in the area corresponding to one half cycle of a series of trapezoidal bends, the projection being made normal to the direction of fluid path, and L being the length of each heat-transfer element.

3. A heat exchanger according to claim 2 wherein l is at least 2.5 mm.

4. A heat exchanger according to claim 1 wherein $A_2/A_1$ is set to a value of no more than 0.5, $A_1$ being the width of the larger portion of a fluid passage and $A_2$ being the width of the smaller portion of said fluid passage.

5. A heat exchanger according to claim 4 wherein $A_2/A_1$ is at least 0.1.

6. A heat exchanger according to claim 1 wherein the diameter, d, of each of the through-holes is within the range of 0.5–6.0 mm.

7. A heat exchanger according to claim 1 wherein the relative opening, $\beta$, of through-holes is within the range of 0.05–0.3.

8. A heat exchanger according to claim 1 wherein each of the trapezoidal bends in an individual heat-transfer element is such that the inclined sides thereof make an angle, $\theta$, of 25°–65° with respect to the direction of fluid flow.

9. A heat exchanger according to claim 1 wherein some of the through-holes are located in the inclined side portions of the heat-transfer elements.

10. A heat exchanger according to any one of claims 1 to 9 wherein each of said heat-transfer elements is thermally coupled to a second heat-transfer element having a temperature difference from said first heat-transfer elements.

11. A heat exchanger according to claim 10 wherein said second heat-transfer element passes through the stack of said first heat-transfer elements and is positioned normal to the direction of the flow of the fluid flowing along said first heat-transfer elements.

12. A heat exchanger according to claim 10 wherein said second heat-transfer element is a pipe through which a second fluid flows.

13. A heat exchanger according to claim 11 wherein said second heat-transfer element is a pipe through which a second fluid flows.

* * * * *